US010518117B2

(12) United States Patent
Steingass et al.

(10) Patent No.: US 10,518,117 B2
(45) Date of Patent: Dec. 31, 2019

(54) FIREFIGHTING NOZZLE

(71) Applicant: TASK FORCE TIPS, INCORPORATED, Valparaiso, IN (US)

(72) Inventors: Robert W. Steingass, Valparaiso, IN (US); William D. Walker, Valparaiso, IN (US); Erin L. Roark, Valparaiso, IN (US); John L. Christos, Valparaiso, IN (US); Kimberly A. Hale, La Crosse, IN (US); Stewart McMillan, Valparaiso, IN (US)

(73) Assignee: TASK FORCE TIPS LLC, Valparaiso, IN (US)

( * ) Notice: Subject to any disclaimer, the term of this patent is extended or adjusted under 35 U.S.C. 154(b) by 253 days.

(21) Appl. No.: 15/286,921

(22) Filed: Oct. 6, 2016

(65) Prior Publication Data

US 2017/0100616 A1 Apr. 13, 2017

Related U.S. Application Data

(60) Provisional application No. 62/240,302, filed on Oct. 12, 2015.

(51) Int. Cl.

| | |
|---|---|
| ***A62C 31/03*** | (2006.01) |
| ***B05B 1/34*** | (2006.01) |
| *B05B 1/12* | (2006.01) |

(52) U.S. Cl.

CPC ..... *A62C 31/03* (2013.01); *B05B 1/3402* (2018.08); *B05B 1/3405* (2013.01); *B05B 1/12* (2013.01)

(58) Field of Classification Search

CPC ..... A62C 31/02; A62C 31/03; B05B 1/12; B05B 1/3402; B05B 1/3405; B05B 1/3415

(Continued)

(56) References Cited

U.S. PATENT DOCUMENTS

| | | | |
|---|---|---|---|
| 53,175 | A | 3/1866 | Oyston |
| 72,372 | A | 12/1867 | Curtis et al. |

(Continued)

FOREIGN PATENT DOCUMENTS

| | | | |
|---|---|---|---|
| DE | 238337 | C | 9/1911 |
| EP | 0691183 | B1 | 9/1999 |
| GB | 2102699 | A | 2/1983 |

OTHER PUBLICATIONS

International Search Report and Written Opinion, International Application No. PCT/US2016/056222, dated Dec. 22, 2016.

*Primary Examiner* — Jason J Boeckmann

(74) *Attorney, Agent, or Firm* — Marshall, Gerstein & Borun LLP

(57) ABSTRACT

A new firefighting nozzle has a series of moveable vanes that extend inwardly from a peripheral wall of a base. The inner side of the vanes extends between ⅛ and ⅜ of the diameter of the central channel. The vanes rotate between a linear position, in which the vanes are generally parallel to the direction of the channel, and a vortex position, in which the vanes are significantly angled with respect to the direction of the channel. In the linear position, smooth bore linear flow is produced. In the vortex position, any of a range of fog patterns are produced. An externally mounted controller connects to the vanes and enables a firefighter to change the shape of the nozzle's spray without interrupting the flow. The controller and base have a series of pins that slide in a spiral groove and cause the shaper to move axially with respect to the base when the shaper is rotated about the base. Radial stems that ride in a circumferential slot translate that axial movement into rotation of the vanes.

10 Claims, 15 Drawing Sheets

(58) Field of Classification Search
USPC ..... 239/479, 456, 505, 507, 513, 202, 503; 251/305
See application file for complete search history.

(56) References Cited

U.S. PATENT DOCUMENTS

| | | | | |
|---|---|---|---|---|
| 280,759 | A | 7/1883 | Oyston | |
| 553,454 | A | 1/1896 | Dosch | |
| 641,933 | A | 1/1900 | Canner | |
| 992,314 | A | 5/1911 | Wheatley | |
| 1,251,118 | A | 12/1917 | Schrank | |
| 2,271,800 | A | 2/1942 | Meussdorfer | |
| 2,337,298 | A | 12/1943 | Nedbor | |
| 2,772,923 | A * | 12/1956 | Henshaw | A62C 31/02 239/479 |
| 2,844,408 | A | 7/1958 | Dickmann | |
| 6,877,676 | B2 | 4/2005 | Saner et al. | |
| 7,097,120 | B2 | 8/2006 | Marino | |
| 8,056,834 | B2 * | 11/2011 | Gardner | B05B 1/32 239/507 |
| 2009/0014559 | A1 * | 1/2009 | Marino | B05B 1/3402 239/514 |
| 2010/0148106 | A1 * | 6/2010 | Whitefield | F16K 1/222 251/305 |
| 2016/0236213 | A1 | 8/2016 | Jenkins et al. | |

* cited by examiner

FIREFIGHTING NOZZLE

BACKGROUND OF THE INVENTION

Firefighting nozzles are made in a wide range of sizes and types for different levels of severity of the hazard to be protected or extinguished, and according to the spray type desired by the firefighter. The simplest form of a firefighting nozzle is simply a hole, most generally made to a converging shape that accelerates water to gain velocity needed to project the water to its target. (The term "water" will be used to refer to any fluid used to fight a fire, whether it be plain water, water plus foaming agents, foam, or some other type of liquid.) In this type of nozzle, there is no void in the water at the point of discharge and the resulting jet is sometimes referred to as a "solid stream." This type of jet will reach a long distance if the water flowing through the nozzle has relatively low turbulence and if water pressure is relatively high, for example in the range of 30 to 150 PSI (about 3 to 10 bar).

While a solid stream jet may be appropriate for many fires, a more dispersed spray pattern is also useful for a variety of needs. Peripheral jet nozzles (also known as fog nozzles) are believed to create sprays with smaller droplet sizes, and it is believed that the smaller droplet size absorbs heat better. Firefighters who are partial to fog nozzles are sometimes partial to fog patterns produced by fog teeth. The fog teeth have an angled face, and water striking that face causes the fog teeth to rotate around the central axis of the nozzle. The gap formed in the spray at each tooth can be seen in high speed photographs.

Many peripheral jet nozzles have a center support within the waterway of the nozzle. (Many garden sprayers use a similar design.) The center support causes the water to discharge from the nozzle with a hole in the center. Many of these nozzles are infinitely variable and can be adjusted to provide anything from a wide fog pattern to a hard-hitting and long-reaching straight stream.

Despite these technologies, some firefighters believe that the hole in the center of a peripheral jet nozzle reduces the effective distance the spray reaches and reduces the ability of the spray to penetrate hot fires to their seat. Thus, many firefighters prefer a smooth bore nozzle (tip) that has no central support and thus leaves no "hole" in the center of the spray. Smooth bores are oftentimes made in sets of two, three, or four nozzles that form a series of converging orifices referred to as a stacked tip. Each smooth bore can be connected to the others in series by a threaded joint and hose gasket. The fireman may choose from any tip size by unthreading tips that are not needed. Some smooth bore nozzles have a constant diameter (instead of a converging diameter). These constant-diameter nozzles are often used for spraying compressed foam.

A smooth bore nozzle does not naturally produce dispersed spray pattern, and many attempts have been made to selectively modify the spray pattern from a smooth bore so that a firefighter can produce a dispersed spray if desired. The modifications have generally been fragile fog producing devices that protrude beyond a heavily modified nozzle. Examples include U.S. Pat. Nos. 53,175, 72,372, 280,759, 553,454, 2337,298 and embodiments shown in U.S. Pat. No. 7,097,120. Nozzles with protruding devices sacrifice the ability to add smaller stacked tips in series beyond the fog producing device. The devices have been seen as prone to clogging with stringy debris. They are also prone to damage during handling, because firefighters sometimes need to use the nozzle at hand to break windows or punch holes in walls, and the nozzles sometimes get tossed to or from a roof.

Devices used to impart rotary motion to the flow from a smooth bore nozzles before the flow is discharged are shown in U.S. Pat. No. 759,320. These nozzles can produce a sprayed jet of water, but cannot produce a straight jet. In addition, obstructions in the center of the waterway block the clear view through the nozzle that smooth bore proponents desire as proof that the nozzle will provide a flow will with no "hole" in the center.

In Europe, particularly Germany, some smooth bore nozzles are fitted with a ball valve having a set of vanes in the center of the ball. The vanes are curved on one end, and the valve operates in any of three positions: straight jet, off, and full fog. When the curved portion of the vanes is downstream, a vortex is formed resulting in a narrow fog pattern from the smooth bore. Although this smooth bore nozzle can produce a fog pattern, the flow has to be interrupted to change spray patterns, and interrupting flow can be dangerous an even life-threatening in a firefighting situation. In addition, the width of the spray pattern is also not adjustable, which is also undesirable.

More recently, the Saberjet and SaberMaster nozzles produced by Akron Brass combine the fog-making ability of a peripheral jet nozzle with the solid stream ability of a smooth bore nozzle by putting a smooth bore nozzle in the center of the fog nozzle, as disclosed in U.S. Pat. No. 6,877,676. The water may be directed to the central smooth bore or to a secondary flow path where water is diverted to form a fog spray. The nozzle looks like a peripheral jet nozzle since the profile of the smooth bore is hidden within the center. This approach was previously shown in older patents including U.S. Pat. Nos. 641,933, 1,251,118, and 2,271,800. These nozzles are relatively heavy and complex compared to peripheral jet nozzles of equal flow. The side channels are quite narrow compared to the central orifice of the smooth bore nozzle, and the secondary flow path is obstructed from plain view, raising concerns that debris may becoming lodged in inaccessible regions. Other operational difficulties arise when transitioning between flow from the smooth bore and flow through the secondary fog channels. Technical difficulties of designing an on/off transition that maintains both a uniform flow, and a seamless spray pattern transition have yet to be surmounted. As a result, the "smooth bore within a fog nozzle" concept remains flawed.

Some firefighters address the problem of not being able to produce dispersed spray from a smooth bore nozzle by partially closing a valve just upstream of the nozzle to create violent turbulence. The turbulence creates a pseudo-fog pattern. For example, a half-way closed ball valve can generate a narrow dispersed spray pattern of about 20 degrees included angle. However, partially closing the valve significantly reduces flow, which in turn sacrifices cooling and extinguishing capacity. Reducing flow through a fixed orifice also reduces nozzle pressure, which decreases spray velocity and increases droplet size resulting in poor performance.

Adjusting fog sprays while fighting a fire should be simple and quick. Systems that require a firefighter to change devices to vary a fog spray are of little value. There is a need for a new type of straight bore nozzle; a simple, rugged device that a firefighter can easily and smoothly adapt between providing a smooth bore flow and a range of fog spray patterns.

SUMMARY OF THE DISCLOSURE

The new nozzle enables a firefighter to switch between smooth bore flow and a continuous variety of selective fog sprays by a simple twist of the wrist. The new nozzle can be made in various sizes from hand-held nozzles ranging from those for handling flows from as low at 5 GPM (20 LPM) to those for handling flows up to 350 GPM (1300 LPM), to monitor-mounted nozzles with flows from 350 GPM (1300 LPM) to 20,000 GPM (76,000 lpm).

The illustrated firefighting nozzle has a base with a central channel through which water flows. A set of vane elements are mounted for movement in the base and can be used to shape the flow. An externally mounted controller is connected to the vanes and enables a user to easily change the position of the vanes in the central channel and thereby change the shape of spray exiting downstream without interrupting the flow. In the illustrated embodiment, the spray exits through a smooth bore tip that is mounted downstream of the base.

The base has a central channel that is defined by a peripheral wall on the base. The illustrated central channel has a circular cross-section. Standard firefighting connections are provided at opposed ends of the peripheral wall.

In the illustrated embodiment, the vane elements are mounted for rotation with respect to the base. Each vane element has a vane that extends radially inwardly from the peripheral wall. The vanes have an inner side that is spaced radially inwardly from the peripheral wall. The distance between peripheral wall and the inner side of the vanes is between ⅛ and ⅜ of the diameter of the central channel.

The illustrated vanes pivot about axes that are generally perpendicular to the axis of the central channel, and are movable between a linear position, in which the vanes are generally parallel to the direction of the channel, and a vortex position, in which the vanes are significantly angled with respect to the direction of the channel. In the linear position, the smooth bore tip produces linear flow. In the vortex position, the vanes impart rotational movement to liquid flowing through the central channel, resulting in the smooth bore tip spraying a fog pattern.

The externally mounted controller enables the user to change the position of the vanes while liquid continues to flow through the nozzle. In the illustrated embodiment, the externally mounted controller is a shaper mounted around the base. The shaper and base have a series of pins that slide in a spiral groove and cause the shaper to move axially with respect to the base when the shaper is rotated about the base.

Associated connectors on the shaper connect to connectors on the vane elements and move axially with respect to the base when the shaper is rotated about the base. In the illustrated example, the connectors and associated connectors comprise radial stems that ride in a circumferential slot, causing the vanes to rotate when the elements of the controller move axially with respect to the base. This arrangement enables a firefighter to selectively pivot each vane between the linear position and the vortex position by twisting the shaper with respect to the base, the resulting axial movement of the shaper driving re-orientation of the vanes.

The disclosed device provides a parallel flow with no "hole" in the center, yet can be continuously and uninterruptedly transitioned to a range of fog patterns without reducing the flow.

Some embodiments of the new device can provide spray angles up to 180 degrees, and can offer a connection point onto which a variety of smooth bore nozzles can be interchangeably mounted. In some embodiments, the relatively unobstructed flow path may enable large debris to pass in flushing under the requirements of NFPA 1964 2014. In some embodiments, the nozzle can be integrated with a shutoff valve.

DETAILED DESCRIPTION

Figure 1A:
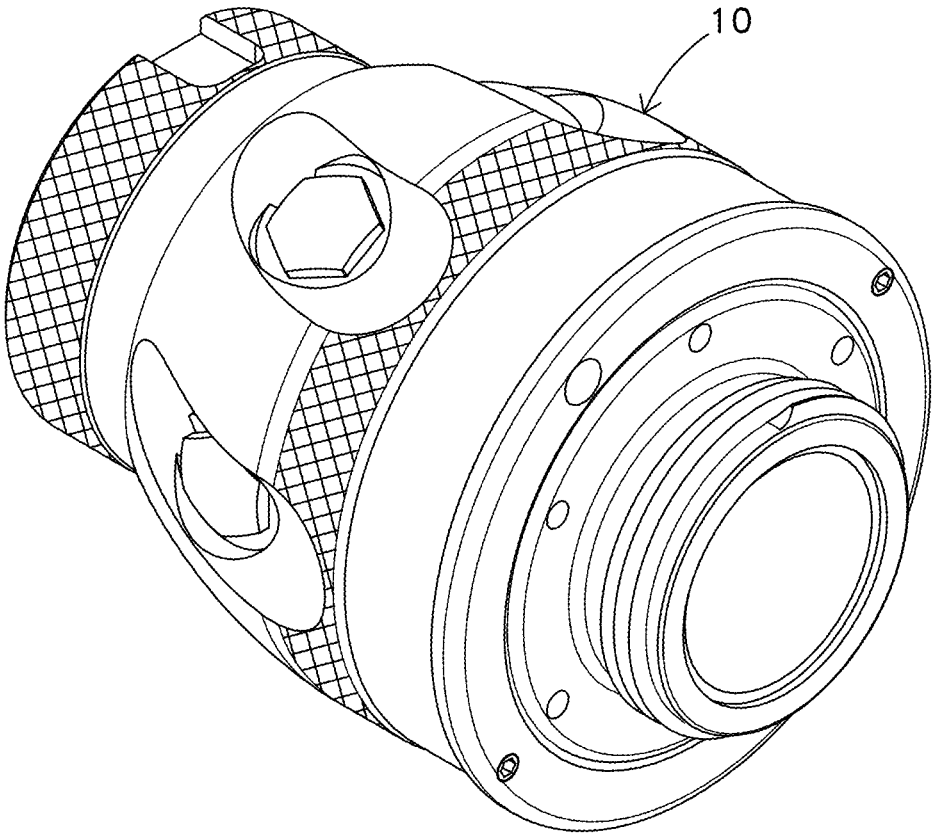
FIGS. 1A and 1B are perspective views of two examples of firefighting nozzles that embodies the new invention.
Figure 1B:
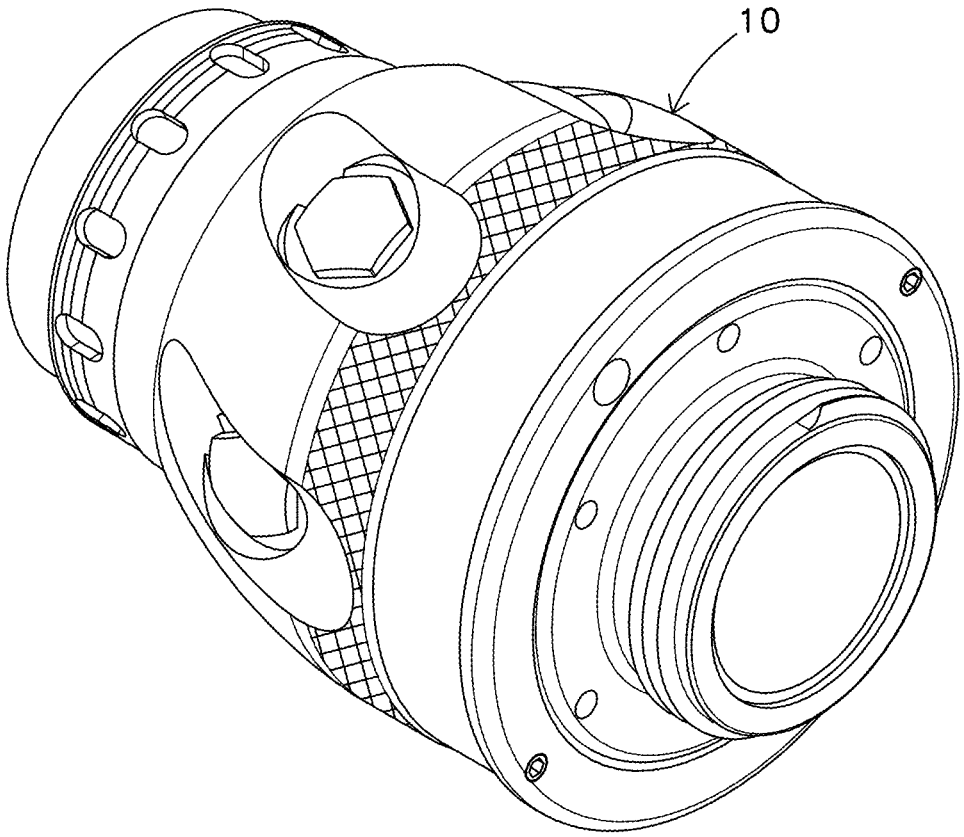
Figure 2:
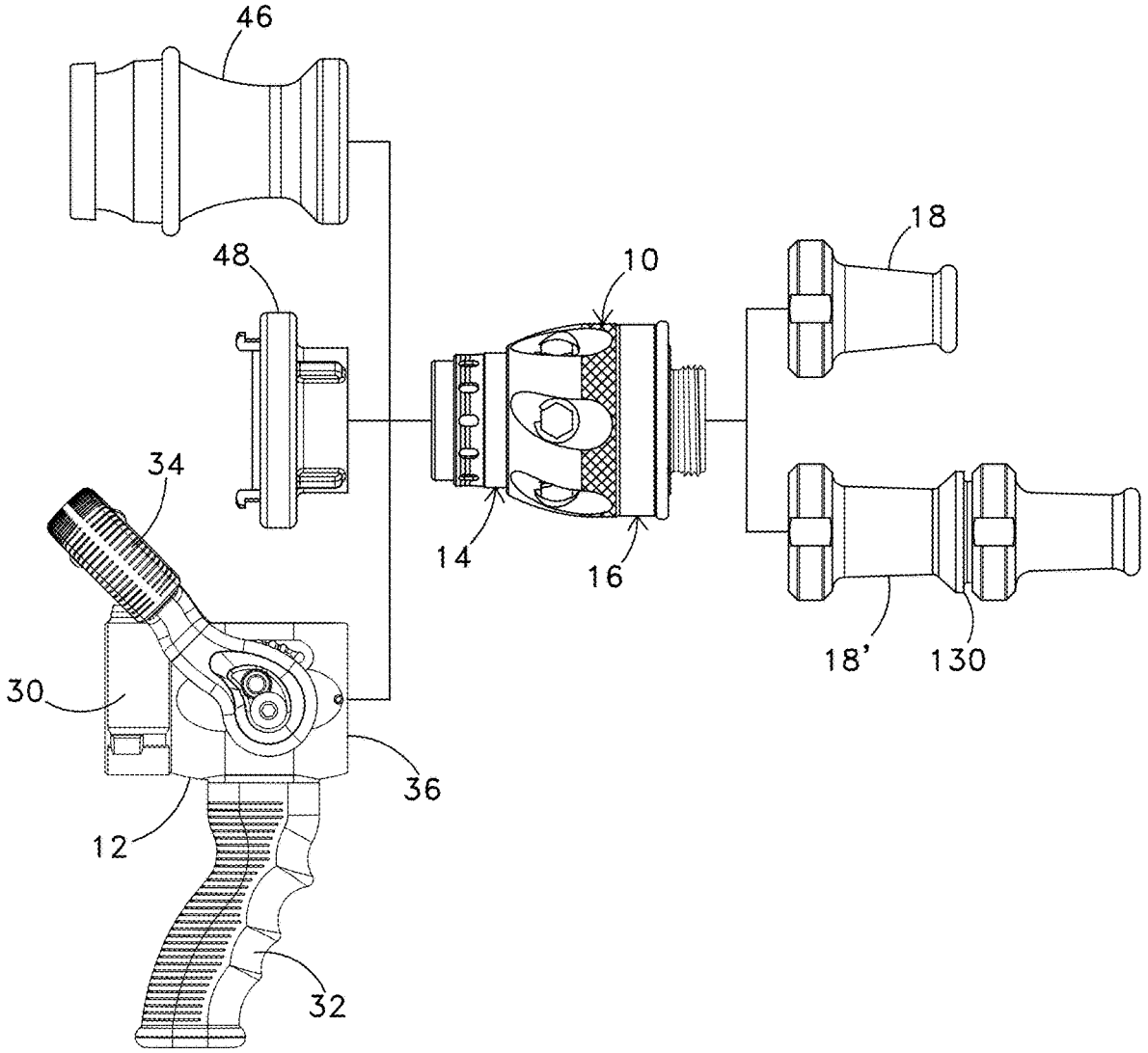
FIG. 2 is a component view of possible uses of the nozzle of FIG. 1B in a nozzle assembly.

FIGS. 1A and 1B show two embodiments of firefighting nozzles 10 in accordance with the present invention. As seen in FIG. 2, the illustrated nozzles can be used in nozzle assemblies that have four primary components: a valve body 12, a base 14, an externally mounted controller (in this case in the form of a shaper 16), and a tip 18 or 18'.

The Valve Body

Figure 3:
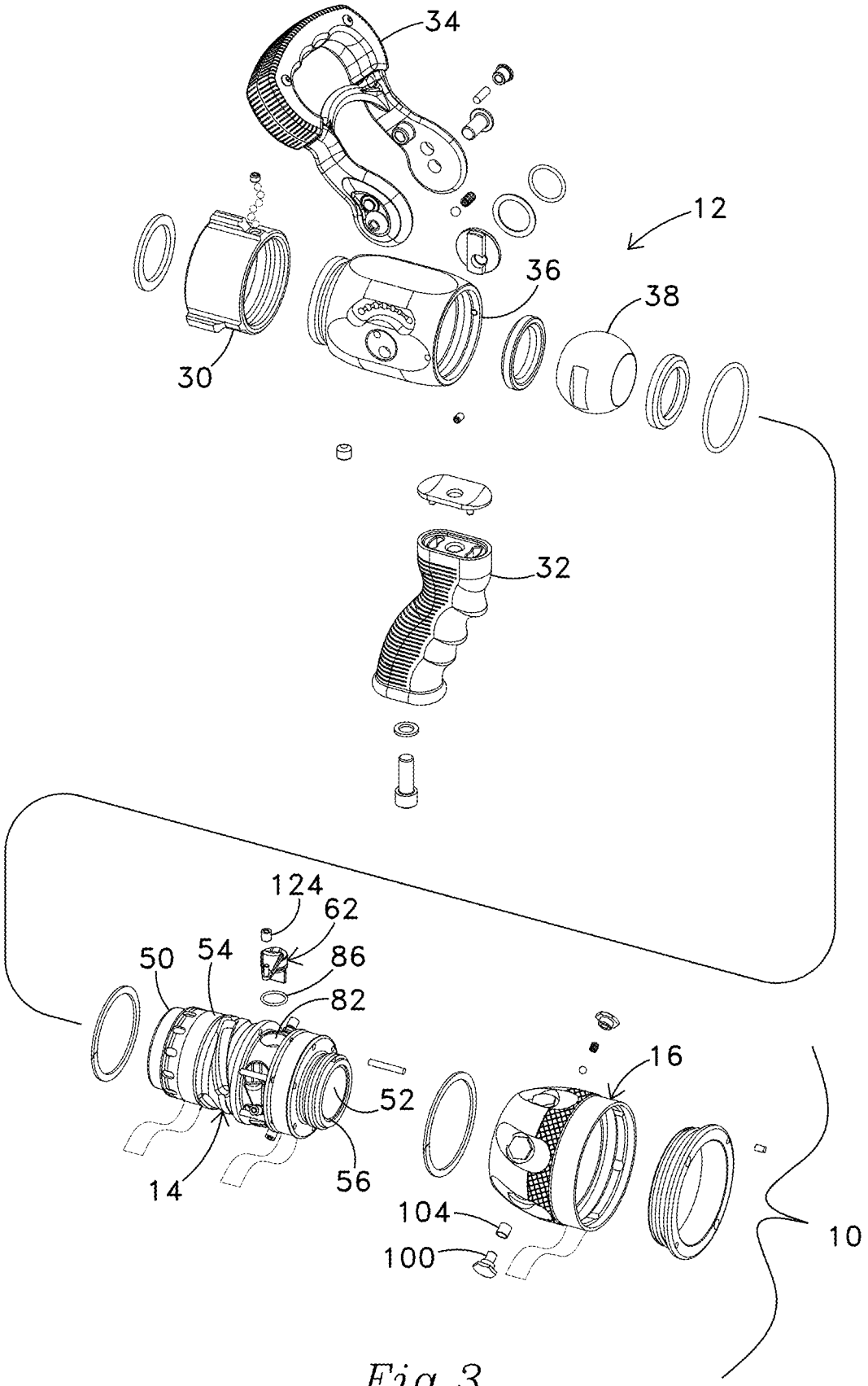
FIG. 3 is a exploded view of the three of the components of one of the possible nozzle assemblies of FIG. 2.
Figure 4:
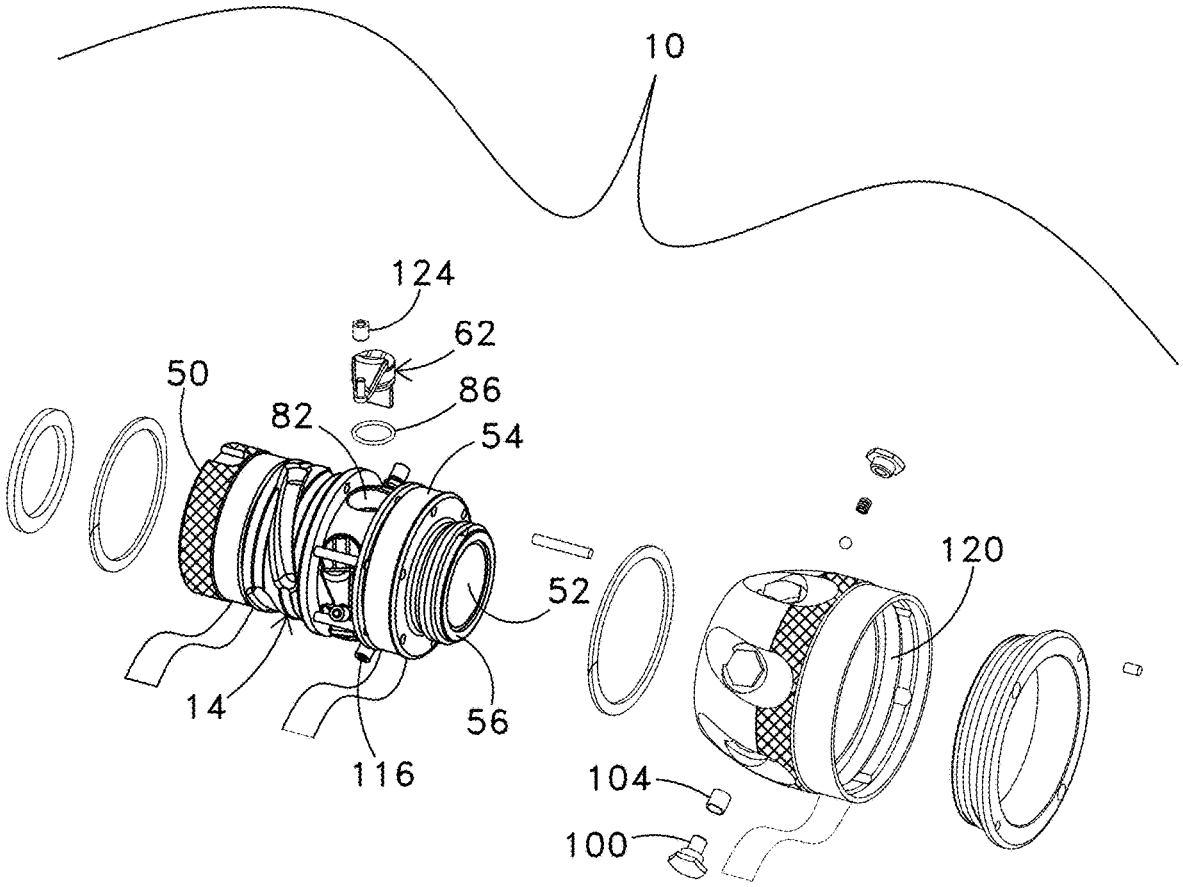
FIGS. 4 and 5 are enlarged exploded views of two of the components of the nozzle of FIG. 1A.

The illustrated valve body 12 includes a hose coupling 30, an optional pistol grip 32, a handle 34, and a valve outlet 36. The hose coupling is used to attach the nozzle to a fire hose. The pistol grip provides a convenient handle for the firefighter. As seen in FIG. 3, the handle connects to a valve ball 38 mounted within the valve body, and enables the firefighter to change the position of the valve ball, and thus control the flow of water through the valve body.

FIG. 2 illustrates other embodiments of firefighting nozzle assemblies that do not use a valve body. In those embodiments, water may be delivered to the base 14 of the nozzle 10 through a quarter turn hose coupling 46 or through a British instantaneous hose coupling 48.

The Base

As seen in FIGS. 3-6 the base 14 of the nozzle 10 has a base inlet 50 that leads to a central channel 52 (FIG. 6) through which water from the valve body 12 flows. The central channel is defined by a peripheral wall 54. The illustrated central channel has a circular cross-section and a 1.5" diameter. Standard firefighting connections are optionally provided at both the base inlet and at a base outlet 56 at the opposite end of the peripheral wall. In this embodiment, a male hose thread is used on the base outlet, and a female coupling with external wrenching lugs is used on the inlet end. These details can be varied.

A set of vane elements 62 are mounted for movement in the base 14.

In other embodiments of the invention, the vanes can be arranged to move within a slot and have a first position in which the inner edges of the vanes do not extend into the central channel but instead lie at an inclined angle along the peripheral wall. Such vanes can be moved into the central channel by either radial movement of the entire vane or by rotation of the vane about an axis that is generally normal to the surface of the peripheral wall. Generally, the more of the vane that is moved into the central channel, the more rotation will be provided to the liquid flowing through the nozzle.

In general, however, it is thought to be preferable to arrange the vanes so that they rotate about an axis perpendicular to the peripheral wall, between a first position in which the vanes lie generally parallel to the axis of the central channel and a vortex position in which the vanes are inclined with respect to that axis.

Figure 7:
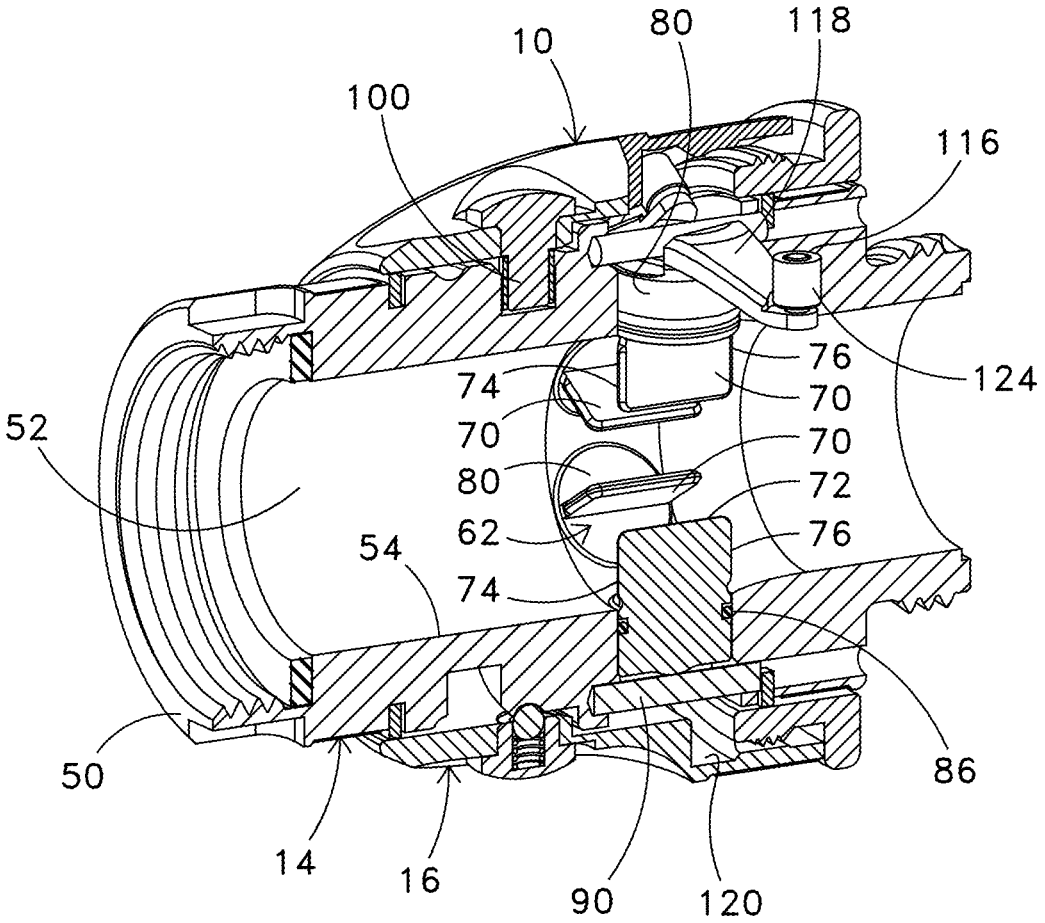
FIG. 7 is a cut-away perspective view with the vanes in the first position.
Figure 8:
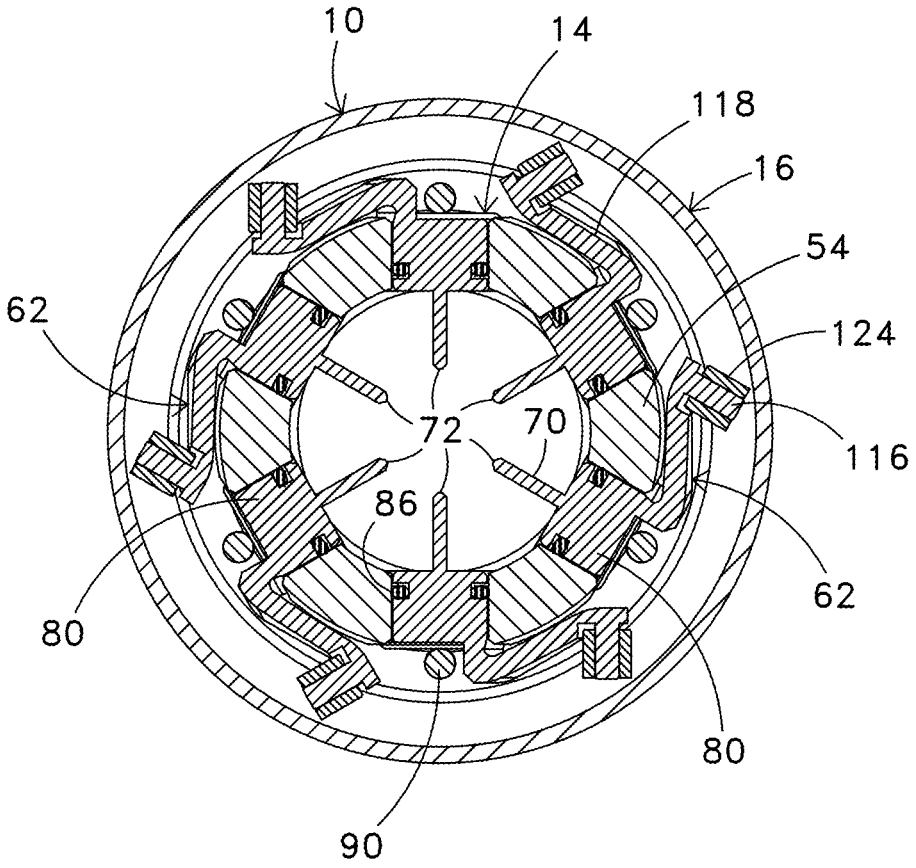
FIGS. 8 and 9 are cross-sectional views through sections 8-8 and 9-9 of FIG. 6.
Figure 9:
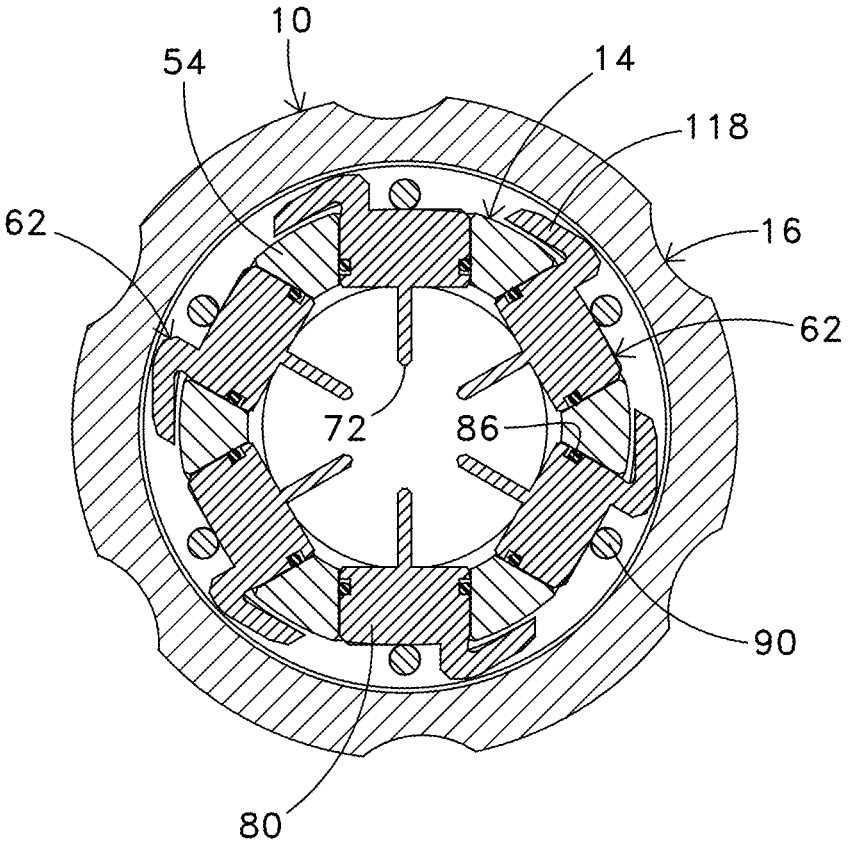

As best seen in FIGS. 7-9, each vane element in the illustrated embodiment has a vane 70 that extends radially inwardly from the peripheral wall 54. Each vane has an inner edge 72 that is spaced radially inwardly from the peripheral wall. The distance between peripheral wall and the inner side of the vanes is preferably between ⅛ and ⅜ of the diameter of the central channel 52. The illustrated base has a circular array of six vanes that protrude into the central channel. The inner edges 72 are straight. In this example, the leading edges 74 and the trailing edges 76 (FIGS. 6 and 7) of each vane are perpendicular to the axis of the central channel 52, but in some cases in may be advantageous to angle one or both of those edges, or the inner edge.

The vanes 70 can be used to shape the flow of water through the nozzle 10. Water flowing through the central channel 52 from the base inlet 50 encounters the vanes and is directed to flow along the planes of the vanes. The positioning of the inner edges 72 leaves a zone of water in the center of the channel that does not encounter the vanes.

The illustrated vane elements 62 are mounted for rotation with respect to the base 14. As seen in FIGS. 8 and 9, each of the illustrated vane elements has a cylindrical section 80 that fits within a bore 82 in the base (FIGS. 3 and 4) and pivots about a vane axis that is generally perpendicular to the axis of the central channel 52. Although the axes of the illustrated vane elements all intersect a single point on the axis of the central channel, some or all of the vane elements may alternately be arranged to have their central axes pointing askew.

Undesirable leakage will occur if the periphery of the vane elements 62 are not sealed. In this example, an o-ring 86 provides a fluid-tight seal between the bore 82 in the peripheral wall 54 and the cylindrical section 80 of each vane element. The seal can be provided at other locations, and in other ways.

Dowel pins 90 are used to retain the vane elements 62 within the bores 82. Retention is needed to not only counteract gravity, but also pressure. The illustrated dowel pins fit in holes in the base 14 and slide over the outer side of the cylindrical sections 80 of the vane elements. Other arrangements can be used.

Figure 10:
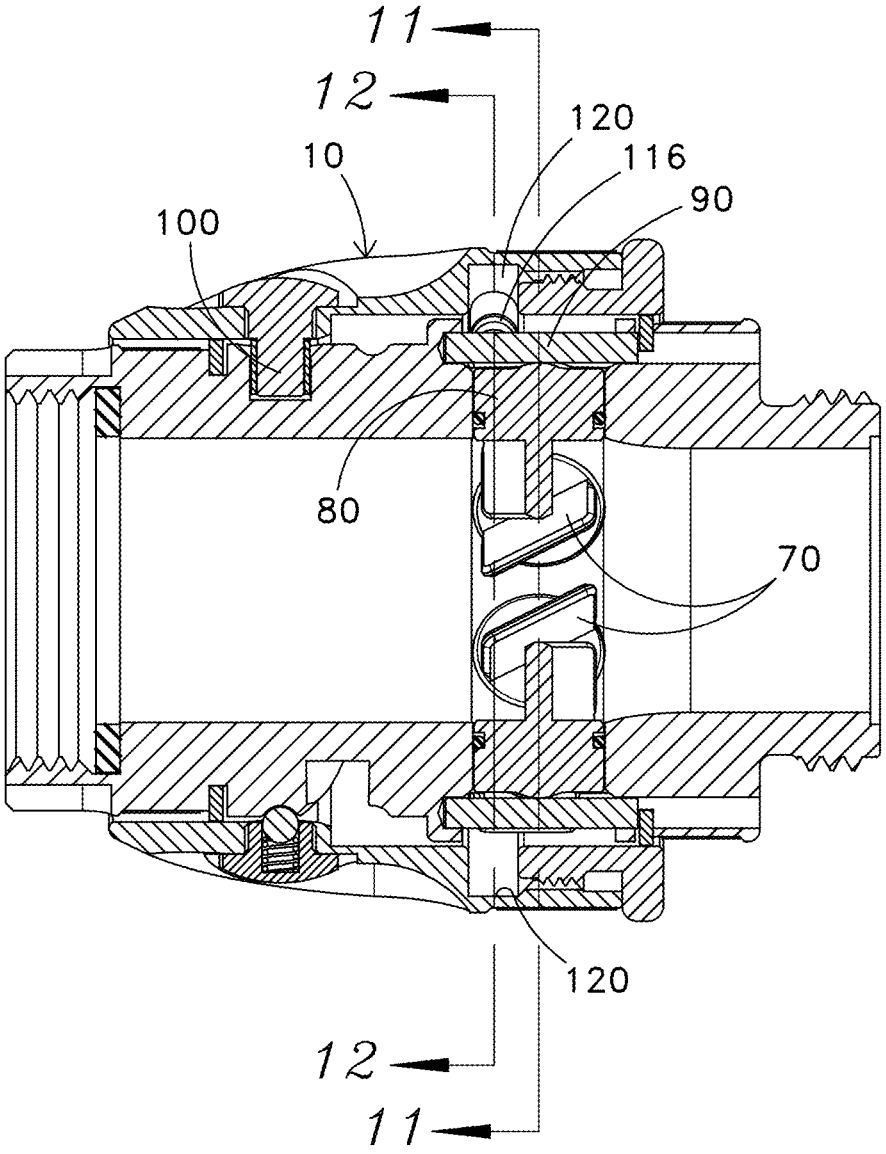
FIG. 10 is a cross-section of the two components, with the vanes in a second position.
Figure 11:
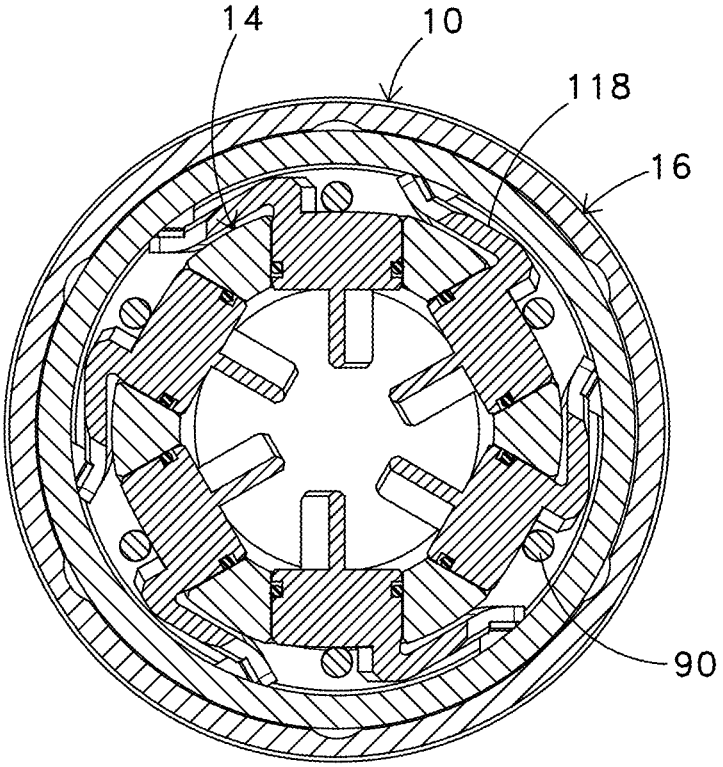
FIGS. 11 and 12 are cross-sectional views through sections 11-11 and 12-12 of FIG. 10.
Figure 12:
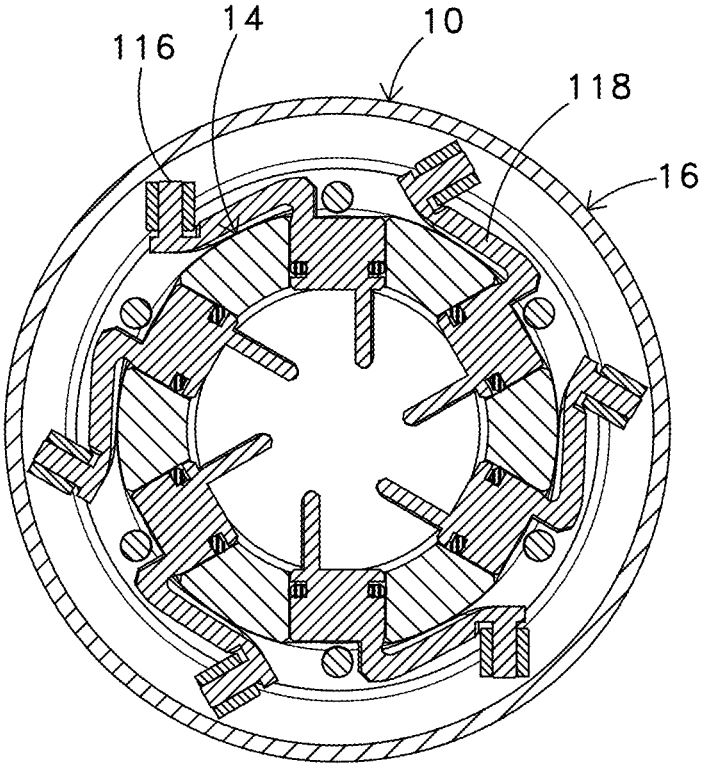

The cylindrical sections 80 of the vane elements 62 rotate within the bores 82 and are movable between a linear position, seen in FIGS. 6-9, and a vortex position, seen in FIGS. 10-12.

In the linear position, the vanes 70 of the vane elements 62 extend generally parallel to the axis of the central channel 52. In this position, the vanes act as stream straighteners and may condition the water flow by removing turbulence caused by a monitor, valve, reducer, or pipe fitting. When the vanes are in the linear position, water exiting the base outlet 56 into the tip 18 produces linear flow, maximizing the throw distance of the nozzle.

Figure 13:
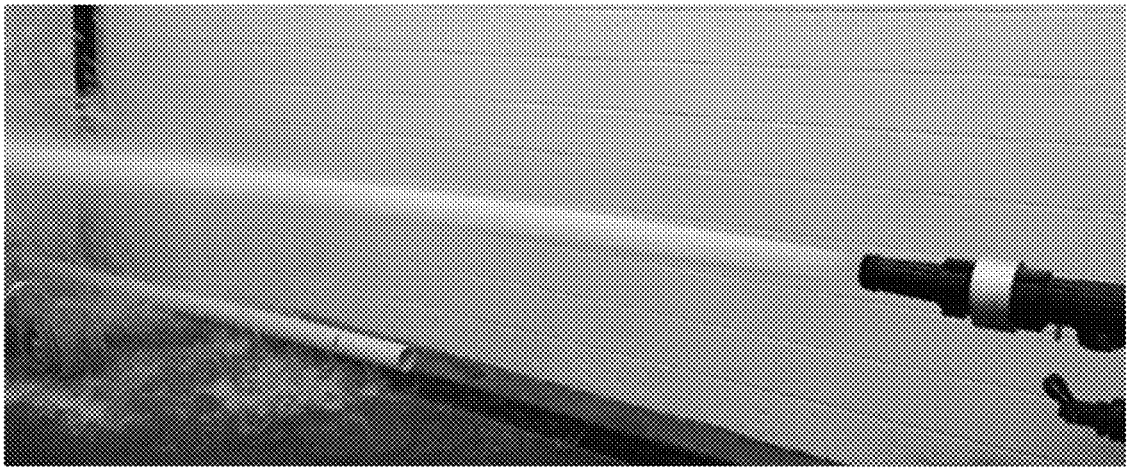
FIG. 13 is a view of the spray discharged when the vanes are in the first position.

FIG. 13 shows the straight jet produced by the nozzle of FIG. 1 when the vanes 70 are in the linear position. When a firefighter is using a tip with a 1" (2.54 mm) outlet diameter and discharging a flow of 300 gallons per minute (1135 liters per minute) flow at 100 psi (6.8 bar), this straight jet configuration can produce a jet stream that will generally reach about 215 feet (65.5 M) when discharged at an elevation of 32 degrees above horizontal.

Some monitors have a corkscrew design and induce some rotational turbulence in the flow. For these or comparable situations, operating the vanes at a small angle may be needed to produce linear flow.

Figure 14:
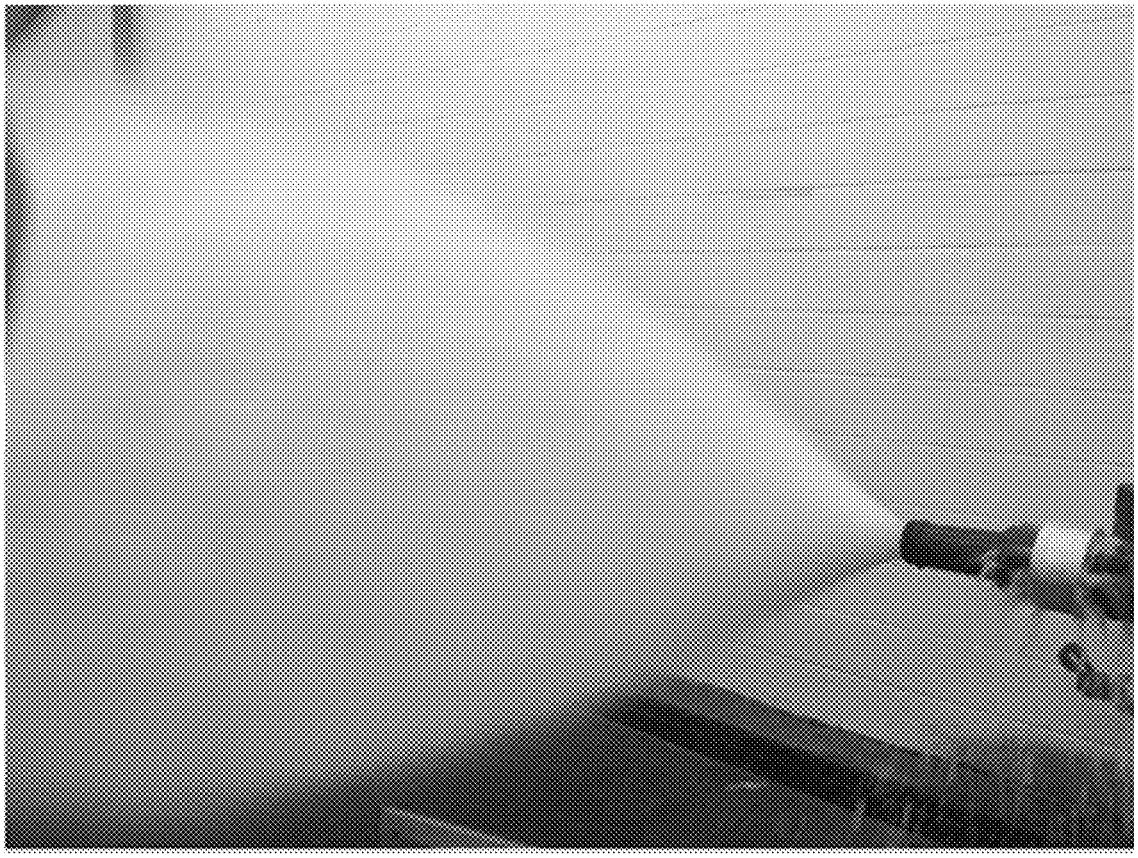
FIG. 14 is a view of the spray discharged when the vanes are in the second position.
Figure 15:
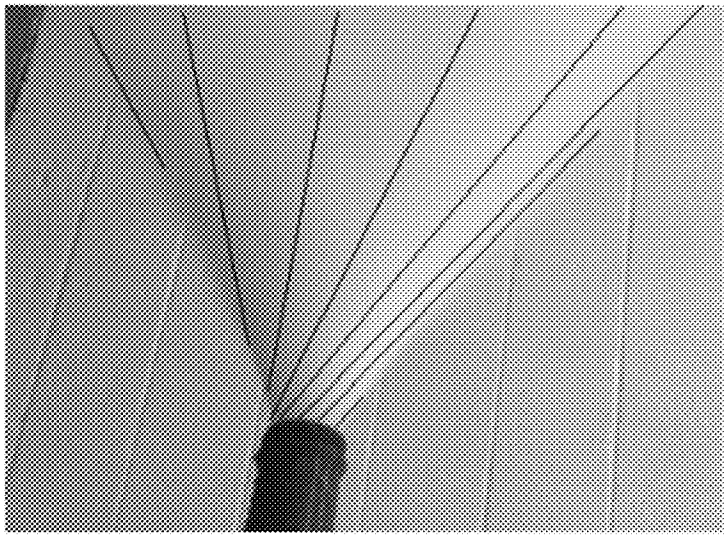
FIG. 15 is a view an enlarged view of FIG. 14.

In the vortex position, the vanes 70 are significantly angled with respect to the axis of the central channel 52. When the vanes are in the vortex position, the vanes impart rotational movement to water flowing through the central channel. The water is discharged from the base outlet 56 and enters the tip 18 as a vortex (spinning water) with significant rotational momentum. This causes the nozzle to produce a fog spray pattern, as seen in FIG. 14. The spray pattern is generally conical in shape. Up-close visual examination of the spray pattern near the point of discharge shows streamlines that emanate from the nozzle at an angle with respect to the central axis. This angled orientation is believed to result from the rotational momentum of the water imparted by the vanes. The spray has a twisted appearance that some would describe as "spinning." This is depicted in FIG. 15, where approximate streamlines have been added to show that the water, which arrives at the mouth of the nozzle as a helical flow, is discharged with streamlines directed along straight lines to form what appears to be a twisted (spinning) cone.

Several factors control the degree of rotational momentum induced by the new device. For example:

The distance that one or more vanes extend toward the center from the peripheral wall could be varied.

The number of vanes could be changed.

The range of motion of one or more vanes could be varied.

The length of the one or more vanes could be varied.

The profile of one of more vanes could be varied, for example by clipping or angling edges, or using vanes with non-planar side surfaces.

The thickness of one or more vanes could vary across its width or length.

It is preferable that the rotation of the vanes 70 in each direction be limited. Excessive vane angles occlude the flow, reduce the nozzle pressure and velocity, and increase droplet size. It is believed that vane angles beyond 45 degrees have diminishing value.

The Controller

The externally mounted controller is connected to the vanes 70 and enables a firefighter to change the position of the vanes while water continues to flow through the base 14. By doing this, the firefighter can change the nature and shape of the spray exiting downstream.

Figure 5:
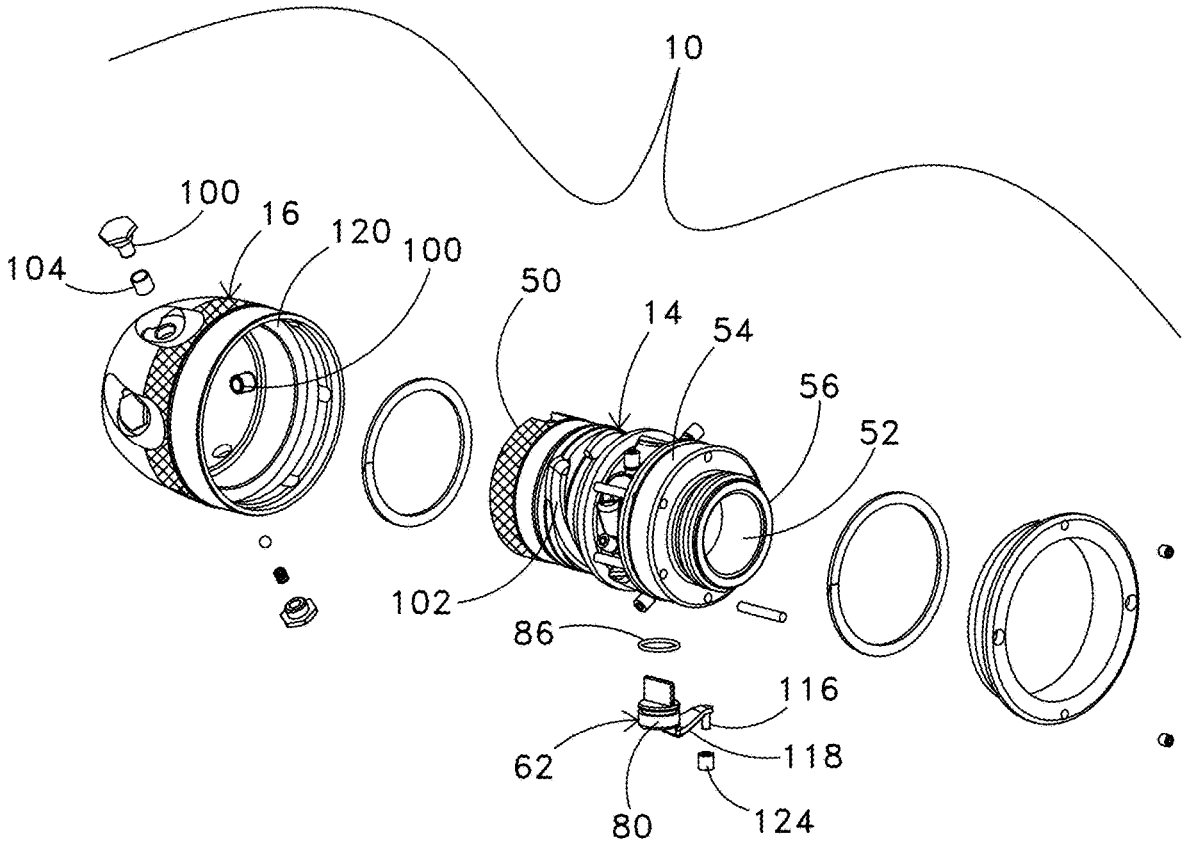
Figure 6:
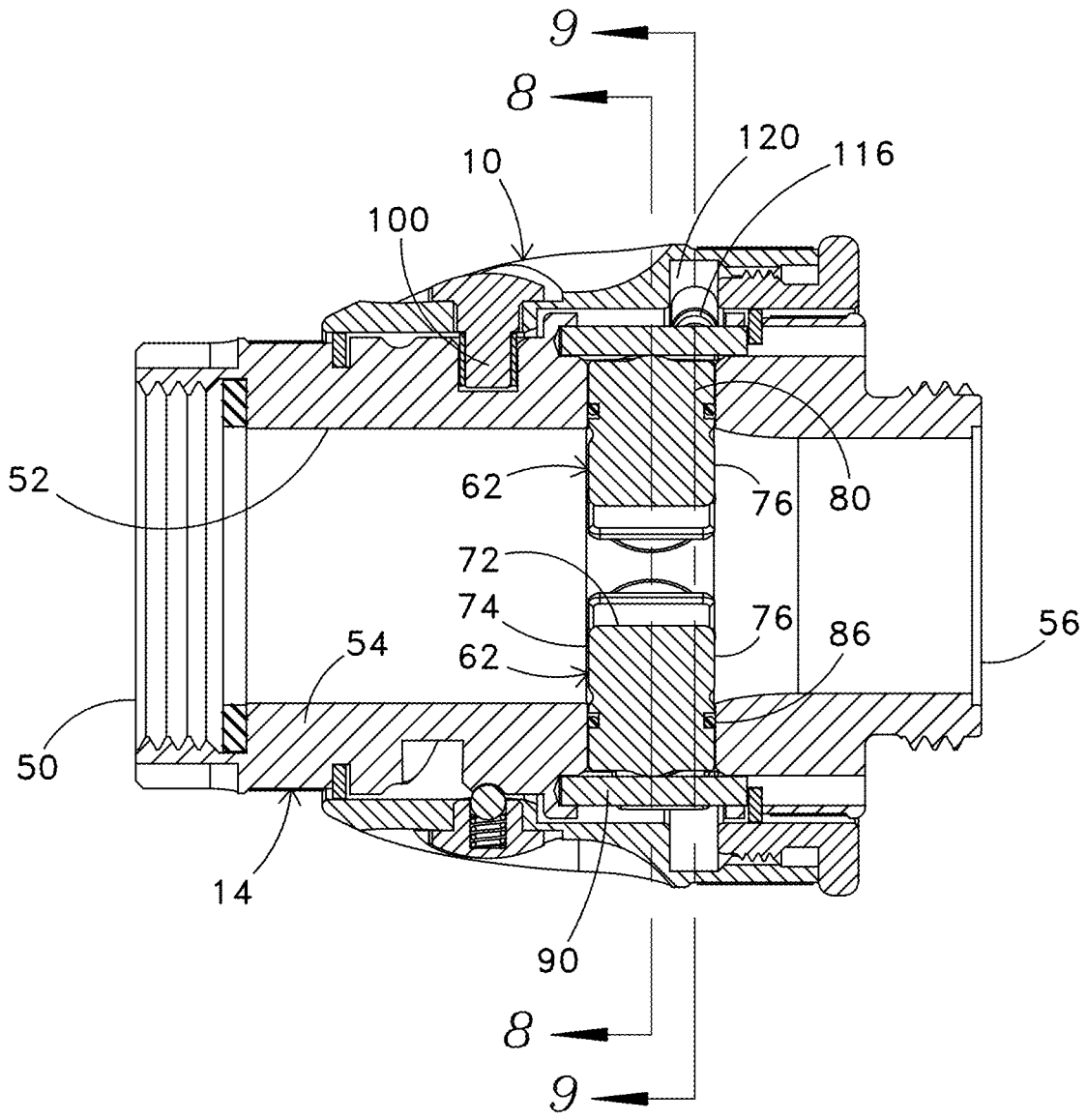
FIG. 6 is a cross-section of the two components, with the vanes in a first position.

As noted above, the illustrated nozzle 10 uses an externally mounted controller that is in the form of a shaper 16 mounted around the base 14. As seen in FIG. 5, the shaper and the base have a series of pins 100 that slide in a spiral groove 102 and cause the shaper to move axially with respect to the base when the shaper is rotated about the base. Preferably, the pins are covered by a cam follower 104 that helps the pins travel smoothly in the groove.

In the illustrated example, the pins 100 are mounted on the shaper 16 and the groove 102 is formed in the base 14. The positions of these elements could be reversed, and other arrangements can be used to convert movement of the shaper into rotation of vane elements. For example, one or more linear actuators or cylinders can be used to move or guide linear movement of the shaper with respect to the base.

A comparable set of parts is used to translate the axial movement of the shaper 16 into movement of the vanes 70. When the vanes are arranged to move by linear motion, the controller can include threads, a helical cam surface, a four-bar mechanism, a hydraulic cylinder, or a linear actuator, to engage a connector in the form of a inclined edge on an outer ring. Pushing or pulling on that inclined edge can push or pull the inner edges of the vanes further into or out of the central channel. When the vanes are arranged to rotate into and out of the channel entirely, the controller can include gear elements that engage gear teeth on portions of the vane. Engagement of those gear teeth can rotate the vanes further into or out of the central channel.

In embodiments like the illustrated one, the translation of the axial movement of the shaper 16 into rotation of the vanes 70 can be achieved with the help of associated connectors 110 that are on the shaper 16 and move axially with respect to the base 14 when the shaper is rotated about the base. These associated connectors connect to connectors 112 on the vane elements 62.

In the illustrated example, the connectors and associated connectors comprise radial stems 116 (FIGS. 5, 7, 8, and 12) that ride in a circumferential slot 120 (FIGS. 4-7, 10). The illustrated stems are on radial arms 118 on the vane elements (FIGS. 5, 7-9, 12). Each stem is parallel to and positioned about 0.9 inches (23 mm) from the axis of the associated vane element. Preferably, each stem is covered by a roller 124. The slot is on the shaper 16. For ease of manufacture, the illustrated slot extends around the entire inside periphery of the shaper. Other arrangements of the elements could be used.

As the shaper 17 moves axially with respect to the base 14, the slot 120 moves axially with respect to the base, applying an off-axis force on the stems 116. This force is applied in a direction perpendicular to the axes of the vane elements 62, and causes the vane elements to rotate about their axes within the bore 82. This movement rotates the vanes 70 within the central channels 52. In the illustrated embodiment of the invention, the radial arms 118 and the stems 116 are arranged so that mid-stroke of the vane element's rotational travel occurs when the arm extends in a direction that is perpendicular to a cross-section through the central channel 52 of the base 14.

Simultaneous engagement of all the connectors 112 with the associated connectors 110 drives all the vanes 70 simultaneously. Alternatively, the connectors can be driven separately by axial, spiral, or rotational movement of one or more drive rings, cranks, links, or gear teeth.

The connection of the stems 116 in the slot 120 causes the vane elements 62 to rotate within their bores 82 when the shaper 16 moves axially with respect to the base 14 This arrangement enables a user to selectively pivot each vane between the linear position and the vortex position by twisting the shaper with respect to the base, the resulting axial movement of the shaper driving re-orientation of the vanes 70.

In some settings, it may be preferably to provide for separate control for individual vanes or groups of vanes. For example, one set of connectors and associated connectors could be arranged control a first set of vanes (such as a set of primary vanes having one configuration), and a second set of connectors and associated connectors could be arranged to control a second set of vanes (such as secondary vanes having a different configuration).

It is helpful to clearly indicate the direction of travel and resulting spray to be expected. The markings are often most helpful on the controller/shaper 16.

The Tip

As noted above, spray from the illustrated nozzle exits through the tip 18 (FIGS. 1 and 2) that is mounted downstream of the base 14. The illustrated tip 18' is a smooth bore nozzle that has a 1.5" (38 mm) hose threaded inlet and 1" (26 mm) diameter orifice. The 1" tip will flow 266 GPM at 80 PSI (1006 LPM at 5.5 bar). The discharge end 130 of the illustrated tip has an optional male thread that is intended for and configured to interconnect in series with one or more additional smooth bore tips of successively decreasing diameter. The resulting stacked tip set is generally used on a firefighting monitor (water cannon) to extinguish house and commercial fires.

This description of various embodiments of the invention has been provided for illustrative purposes. Revisions or modifications may be apparent to those of ordinary skill in the art without departing from the invention. The full scope of the invention is set forth in the following claims.

What is claimed is:

1. A firefighting nozzle that has:

a unitary, one-piece base with a peripheral wall that defines a central channel and has a series of bores that open radially into that channel;

an externally mounted controller that is mounted for movement with respect to the base;

a set of vane elements that are installed in the bores in the base and each have a cylindrical section that rotates within a respective bore on the peripheral wall of the central channel, and a vane on each vane element that extends radially inwardly into the central channel, extends laterally only to the circumference of the cylindrical section of the vane element and not beyond that circumference, is removable from the channel through the bore in which that vane element is installed, and is movable between a) a first position in which the vane lies on a plane that is generally parallel to the direction of the channel, and b) a second position in which the vane lies on a plane that is inclined with respect to the direction of the channel.

2. The nozzle of claim 1 in which the nozzle produces a fog pattern when the vanes are in the second position.

3. The nozzle of claim 1 in which the vanes, when they are in the second position, are significantly angled with respect to the axis of the channel.

4. The firefighting nozzle of claim 1, in which each vane element has a connector that connects to an associated connector that is on the externally mounted controller and moves axially with respect to the base when the controller is rotated about the base, enabling a user to selectively pivot each vane to an inclined position by moving the controller with respect to the base.

5. The nozzle of claim 1, in which:

the central channel has a circular cross-section; and the vanes each have an inner side that is spaced radially from the peripheral wall, and the distance between peripheral wall and the inner side of the vanes is between ⅛ and ⅜ of the diameter of the central channel.

6. The nozzle of claim 4, in which the connector and associated connector comprise radial stems that ride in a circumferential slot.

7. The nozzle of claim 4, in which the vanes, when they are in the second position, are significantly angled with respect to the direction of the channel.

8. The nozzle of claim 1, in which the nozzle also has a pin that retains at least one of the vane elements from outward movement through the bore in which that vane element is installed.

9. An attachment for firefighting nozzles that has:

a base with a central channel that is defined by a peripheral wall and has a series of bores that open radially into that channel;

an externally mounted controller that is mounted for movement with respect to the base;

standard firefighting connections at opposed ends of the peripheral wall;

cylindrical sections that are installed in each bore and rotate about the axis of that bore; and a set of vanes that extend radially inwardly into the central channel from each cylindrical section, extend laterally only to the circumference of the cylindrical section and not laterally beyond that circumference, are each removable from the channel through the bore in which its associated cylindrical section is installed, and are movable between a) a first position in which the vanes lie on planes that are generally parallel to the direction of the channel and b) a second position in which the vanes lie on planes that are inclined with respect to the direction of the channel.

10. The attachment of claim 9, in which the external controller enables the user to change the position of the vanes while liquid flows through the attachment.

* * * * *